US007205941B2

(12) United States Patent
Wang et al.

(10) Patent No.: US 7,205,941 B2
(45) Date of Patent: Apr. 17, 2007

(54) COMPOSITE MATERIAL WITH POWERED RESONANT CELLS

(75) Inventors: Shih-Yuan Wang, Palo Alto, CA (US); Philip J Kuekes, Menlo Park, CA (US); Wei Wu, Mountain View, CA (US); Joseph Straznicky, Santa Rosa, CA (US); M. Saiful Islam, Mountain View, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 227 days.

(21) Appl. No.: 10/931,148

(22) Filed: Aug. 30, 2004

(65) Prior Publication Data

US 2006/0044212 A1 Mar. 2, 2006

(51) Int. Cl.
*H01Q 1/38* (2006.01)
*H01Q 15/02* (2006.01)

(52) U.S. Cl. ..... 343/700 MS; 343/909

(58) Field of Classification Search ..... 343/700 MS, 343/753, 909

See application file for complete search history.

(56) References Cited

U.S. PATENT DOCUMENTS

| | | | | |
|---|---|---|---|---|
| 5,459,800 | A | 10/1995 | Enokihara et al. | |
| 6,661,392 | B2 | 12/2003 | Isaacs et al. | |
| 6,791,432 | B2 * | 9/2004 | Smith et al. | 333/99 S |
| 6,933,812 | B2 * | 8/2005 | Sarabandi et al. | 333/219 |
| 2001/0038325 | A1 | 11/2001 | Smith et al. | |
| 2003/0155919 | A1 | 8/2003 | Pendry et al. | |
| 2004/0066251 | A1 | 4/2004 | Eleftheriades et al. | |
| 2004/0151876 | A1 | 8/2004 | Tanielian | |
| 2006/0125681 | A1 * | 6/2006 | Smith et al. | 342/120 |

FOREIGN PATENT DOCUMENTS

| | | |
|---|---|---|
| EP | 1286418 | 2/2003 |
| WO | WO02/003500 | 1/2002 |
| WO | WO03/054592 | 7/2003 |
| WO | WO04/020186 | 3/2004 |
| WO | WO04/034504 | 4/2004 |
| WO | WO2004/034504 | 4/2004 |

OTHER PUBLICATIONS

O Reynet et al—"Voltage Controlled Metamaterial"—Applied Physics Letters—vol. 84 No. 7—Feb. 16, 2004.

S Lim et al—"Electronically-Controlled Metamaterial-Based Transmission Line as a Continuous-Scanning Leaky-Wave Antenna"—IEEE Microwave Symposium Digest—Jun. 6, 2004.

Pendry, J. et. al., "Reversing Light With Negative Refraction," Physics Today, 57 [6] 37-43 (Jun. 2004).

(Continued)

*Primary Examiner*—Shih-Chao Chen

(57) ABSTRACT

A composite material and related methods are described, the composite material being configured to exhibit a negative effective permittivity and/or a negative effective permeability for incident radiation at an operating wavelength, the composite material comprising an arrangement of electromagnetically reactive cells of small dimension relative to the operating wavelength. Each cell includes an externally powered gain element for enhancing a resonant response of that cell to the incident radiation at the operating wavelength.

38 Claims, 5 Drawing Sheets

OTHER PUBLICATIONS

Brumfiel, G., "Pentagon Attempts to Bend Light to Its Will," Nature, vol. 428 p. 245 (Mar. 18, 2004).

Yen, T.J. et. al., "Terahertz Magnetic Response from Artificial Materials," Science, vol. 303 pp. 1494-1496 (Mar. 5, 2004).

Smith, D. et. al., "Metamaterials and Negative Refractive Index," Science, vol. 305 pp. 788-792 (Aug. 6, 2004).

Yngvesson, K. et. al., "K-Band Traveling-Wave Maser Using Ruby," IEEE Transactions on Microwave Theory and Techniques, vol. MTT-24, No. 11, pp. 711-717 (Nov. 1976).

Boucart, J., et. al., "1-mW CW-RT Monolithic VCSEL at 1.55 μm," IEEE Photonics Technology Letters, vol. 11, No. 6, pp. 629-631 (Jun. 1999).

Linden, K., "Single Mode, Short Cavity, Pb-Salt Diode Lasers Operating in the 5, 10, and 30 μm Spectral Regions," IEEE Journal of Quantum Electronics, vol. QE-21, No. 4, pp. 391-394 (Apr. 1985).

Ramakrishna, S., "Removal of Absorption and Increase in Resolution in a Near-Field Lens Via Optical Gain," Physical Review B 67, 201101(r), pp. 1-4 (2003).

* cited by examiner

COMPOSITE MATERIAL WITH POWERED RESONANT CELLS

FIELD

This patent specification relates generally to the propagation of electromagnetic radiation and, more particularly, to composite materials capable of exhibiting negative effective permeability and/or negative effective permittivity with respect to incident electromagnetic radiation.

BACKGROUND

Substantial attention has been directed in recent years toward composite materials capable of exhibiting negative effective permeability and/or negative effective permittivity with respect to incident electromagnetic radiation. Such materials, often interchangeably termed artificial materials or metamaterials, generally comprise periodic arrays of electromagnetically resonant cells that are of substantially small dimension (e.g., 20% or less) compared to the wavelength of the incident radiation. Although the individual response of any particular cell to an incident wavefront can be quite complicated, the aggregate response the resonant cells can be described macroscopically, as if the composite material were a continuous material, except that the permeability term is replaced by an effective permeability and the permittivity term is replaced by an effective permittivity. However, unlike continuous materials, the resonant cells have structures that can be manipulated to vary their magnetic and electrical properties, such that different ranges of effective permeability and/or effective permittivity can be achieved across various useful radiation wavelengths.

Of particular appeal are so-called negative index materials, often interchangeably termed left-handed materials or negatively refractive materials, in which the effective permeability and effective permittivity are simultaneously negative for one or more wavelengths depending on the size, structure, and arrangement of the resonant cells. Potential industrial applicabilities for negative-index materials include so-called superlenses having the ability to image far below the diffraction limit to $\lambda/6$ and beyond, new designs for airborne radar, high resolution nuclear magnetic resonance (NMR) systems for medical imaging, and microwave lenses.

One issue that arises in the realization of useful devices from such composite materials, including negative index materials, relates to substantial losses experienced by the incident electromagnetic signal when propagating through the composite material. Accordingly, it would be desirable to reduce signal losses in such composite materials. It would be further desirable to provide a general approach to reducing such losses that can be applied to a variety of composite materials operating across a variety of different spectral ranges.

SUMMARY

In accordance with an embodiment, a composite material is provided, the composite material being configured to exhibit a negative effective permittivity and/or a negative effective permeability for incident radiation at an operating wavelength, the composite material comprising an arrangement of electromagnetically reactive cells of small dimension relative to the operating wavelength, wherein each cell includes an externally powered gain element for enhancing a resonant response of that cell to the incident radiation at the operating wavelength.

A method for propagating electromagnetic radiation at an operating wavelength is also provided, comprising placing a composite material in the path of the electromagnetic radiation, the composite material comprising resonant cells of small dimension relative to the operating wavelength, the resonant cells being configured such that the composite material exhibits a negative effective permittivity and/or a negative effective permeability for the operating wavelength. Power is provided to each of the resonant cells from an external power source, each resonant cell being configured to couple at least a portion of that power into a resonant response thereof for reducing net losses in the electromagnetic radiation propagating therethrough A composite material for propagating electromagnetic radiation at an operating wavelength is also provided, comprising a periodic pattern of resonant cells of small dimension relative to the operating wavelength. The resonant cells are configured such that the composite material exhibits at least one of a negative effective permittivity and a negative effective permeability at the operating wavelength. Each resonant cell is configured to receive power from an external power source different than a source of the propagating electromagnetic radiation, and to couple at least a portion of that power into its resonant response for reducing net losses in the propagating electromagnetic radiation.

Also provided is an apparatus configured to exhibit at least one of a negative effective permittivity and a negative effective permeability for incident radiation of at least one wavelength, the apparatus having an arrangement of electromagnetically reactive cells of small dimension relative to that wavelength. The apparatus includes means for transferring external power not arising from the incident radiation itself to each of the cells. The apparatus further includes means for transferring external power not arising from the incident radiation itself to each of the cells.

DETAILED DESCRIPTION

Figure 1:
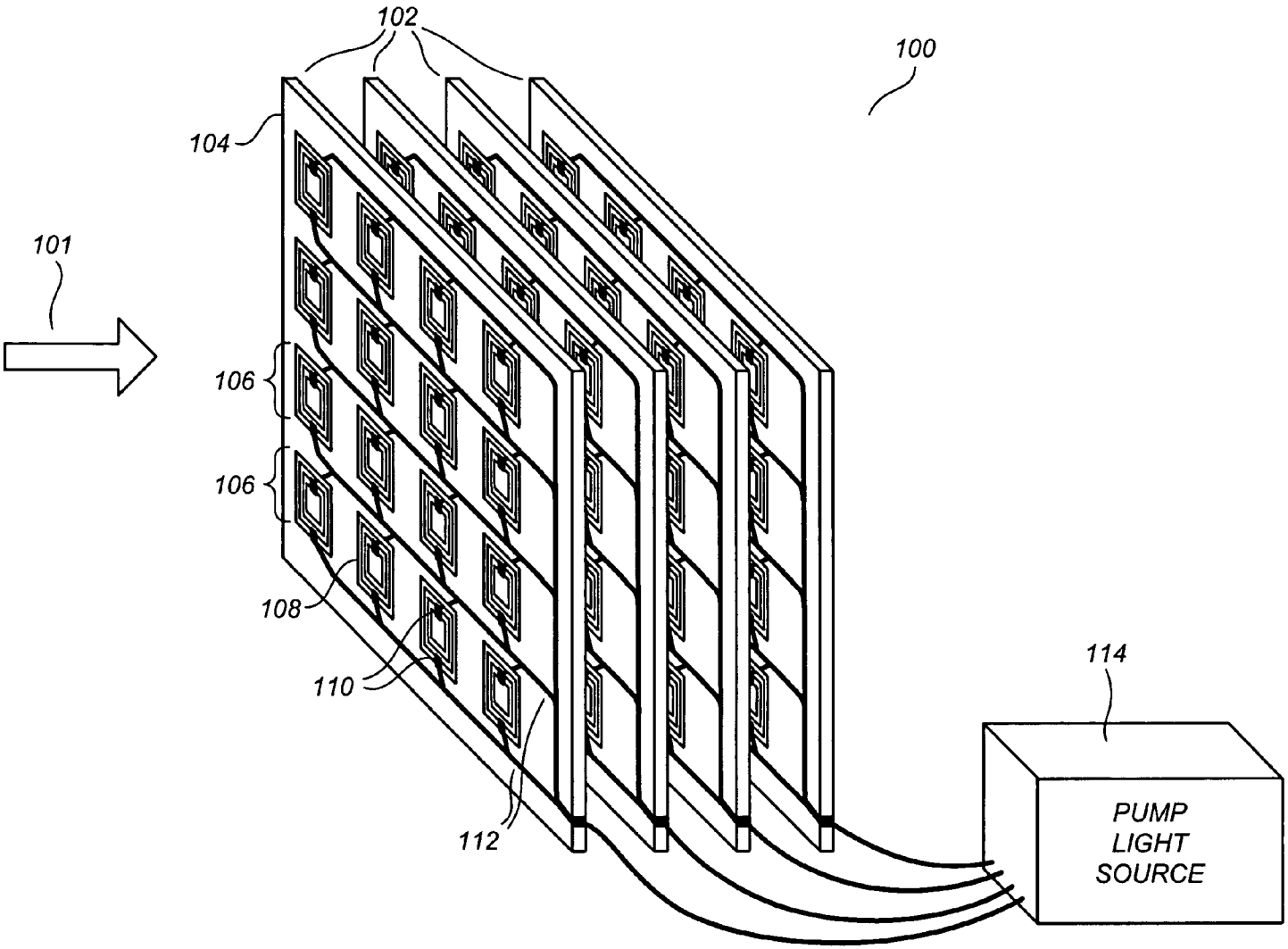
FIG. 1 illustrates a composite material according to an embodiment in which optical waveguides are used to provide power to one or more resonant cells.

FIG. 1 illustrates a composite material 100 according to an embodiment. Composite material 100 comprises one or more planar arrays 102, each formed upon a semiconductor substrate 104. Each planar array 102 comprises an arrangement of resonant cells 106, each having a dimension that is small (e.g., 20 percent or less) than an operating wavelength. As used herein, operating wavelength refers to a wavelength or range of wavelengths of incident radiation 101 for which negative effective permittivity and/or negative effective permeability are to be exhibited in the composite material 100. Thus, by way of non-limiting example, where the desired operating wavelength lies in the mid-infrared region near 10 μm, both the dimension of each resonant cell 106 and the distance between planar arrays 102 should be less than about 2 μm/n, with better performance being exhibited where that dimension is about 1 μm/n or less, where n represents the refractive index of the material. It is to be understood that references to operating wavelengths herein generally refer to free space wavelengths, and that dimensions in the context of operating wavelength on a substrate are to be scaled, as appropriate, according to the refractive index of the substrate at the operating wavelength.

It is to be appreciated that FIG. 1 represents a simplified example for clarity of description, showing only a single set of planar arrays 102 aligned along a direction of propagation of the incident radiation 101. In other embodiments a second set of planar arrays can be provided perpendicular to the first set of planar arrays 102 for facilitating negative effective permittivity and/or negative effective permeability for more directions of propagation. In still other embodiments, a third set of planar arrays can be provided perpendicular to both the first set and second sets of planar arrays for facilitating negative effective permittivity and/or negative effective permeability for even more directions of propagation.

It is to be further appreciated that one or more additional sets of composite and/or continuous-material planes can be placed between the planar arrays 102 without departing from the scope of the present teachings. By way of example, planar arrays consisting of vertical conducting wires on a dielectric support structure can be interwoven with planar arrays 102 to provide a more negative effective permittivity for the overall composite material 100. It is to be further appreciated that the number of resonant cells 106 on the planar arrays 102 can be in the hundreds, thousands, or beyond depending on the overall desired dimensions and the desired operating wavelength.

As illustrated in FIG. 1, each resonant cell 106 comprises a solenoidal resonator 108 that includes a pattern of conducting material having both capacitive and inductive properties and being designed to interact in a resonant manner with incident radiation at the operating wavelength. In the particular example of FIG. 1 the conducting material is formed into a square split ring resonator pattern, but other patterns can be used including, for example, circular split ring resonator patterns, swiss roll patterns, or other patterns exhibiting analogous properties.

Each resonant cell 106 is further provided with a gain element 110 having an amplification band that includes the operating wavelength, the gain element 110 being coupled to receive power from an external power source. The gain element 110 is positioned and configured so as to enhance a resonant response of the resonant cell to the incident radiation at the operating wavelength. Losses in the propagating radiation are reduced by virtue of a coupling of the externally provided power into the response of the resonant cells 106.

Figure 4:
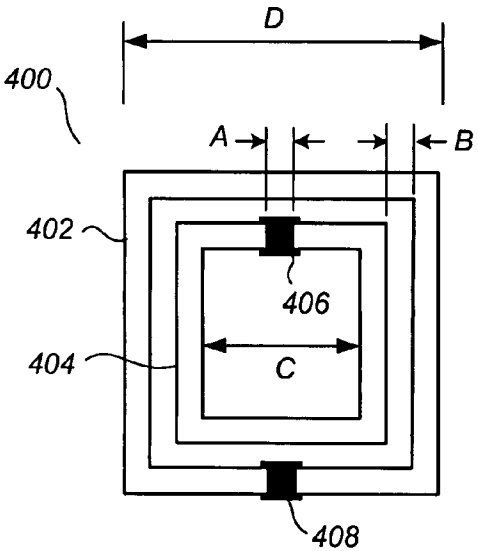
FIG. 4 illustrates a resonant cell of a composite material according to an embodiment having a first spatial arrangement of optical gain material.

In the particular example of FIG. 1, the gain element 110 comprises optical gain elements positioned near the notches of the square split rings, in a manner similar to a configuration that is shown more closely in FIG. 4. Optical gain elements 110 are pumped using pump light from an external optical power source 114 such as a laser. Optical waveguides 112 are used to transfer the pump light to the optical gain elements 110. The optical gain elements 110 are positioned such that a substantial amount of the resonant field occurring in the solenoidal resonator 108 intersects a substantial portion of the optical gain material. The amount of pump light should be kept below an amount that would cause the optical gain elements 110 to begin lasing on their own.

By way of example and not by way of limitation, where the desired operating wavelength lies in the near-infrared region near the 1.3 μm–1.55 μm range, the optical gain material 110 can comprise bulk active InGaAsP and/or multiple quantum wells according to a InGaAsP/InGaAs/InP material system. In the latter case, the semiconductor substrate 104 can comprise a top layer of p-InP material 100 nm thick, a bottom layer of n-InP material 100 nm thick, and a vertical stack therebetween comprising 5–12 (or more) repetitions of undoped InGaAsP 6 nm thick on top of undoped InGaAs 7 nm thick. Where the desired operating wavelength lies in the near-infrared region near the 1.3 μm–1.55 μm range, the resonant cell dimension should be less than about 300 nm, with better performance being exhibited where that dimension is about 150 nm or less. Using known photolithographic techniques including ion implantation, disordering, passivation, etc., and other known techniques as used in VCSEL (vertical cavity surface emitting laser) fabrication and/or SOA (semiconductor optical amplifier) fabrication, the other elements of the planar array 102 such as the optical waveguides 112 can be formed, including the generally inactive areas of the substrate 104. Material systems such as GaAs/AlGaAs, GaAs/InGaAsN, and InGaAs/InGaAlAs can be used for operating wavelengths in the 780 nm–1.3 μm range. In alternative embodiments, the entire wafer can comprise optically active material using one or more of the optical pumping schemes described infra.

Figure 2:
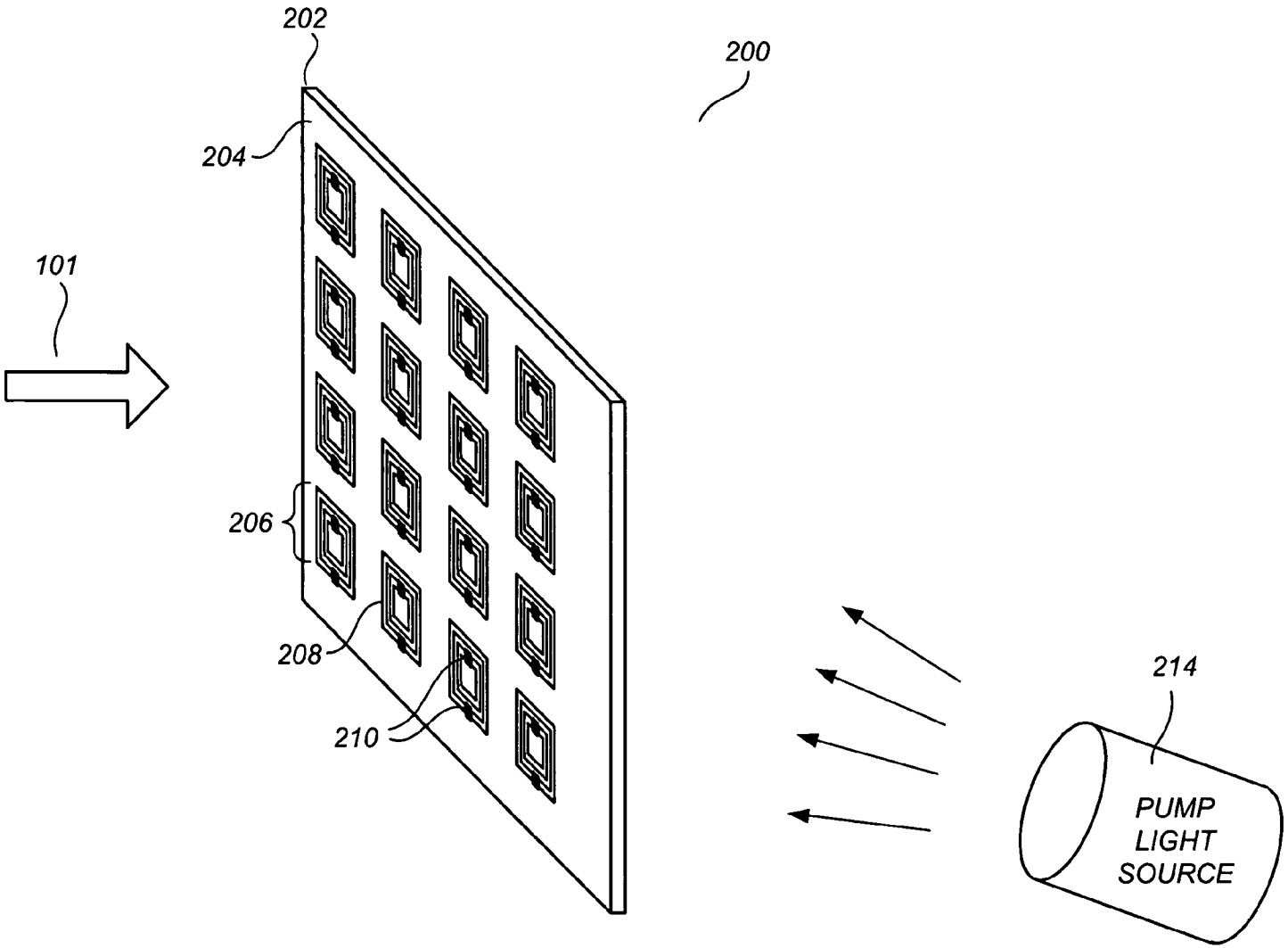
FIG. 2 illustrates a composite material according to an embodiment in which an optical beam is used to provide power to one or more resonant cells.

FIG. 2 illustrates a composite material 200 according to an embodiment in which a common optical beam is used to provide power to one or more resonant cells. A planar array 202 comprising a semiconductor substrate 204, resonant cells 206, solenoidal resonators 208, and optical gain elements 210 are provided in a manner analogous to the embodiment of FIG. 1. However, a pump light source 214 is used to provide a beam of pump light to the planar array 202 from out-of-plane. Empty-space vias (not shown) can optionally be formed into the back of substrate 204 to reduce attenuation of the pump light on its way to the active layers of the optical gain elements 210.

Figure 3:
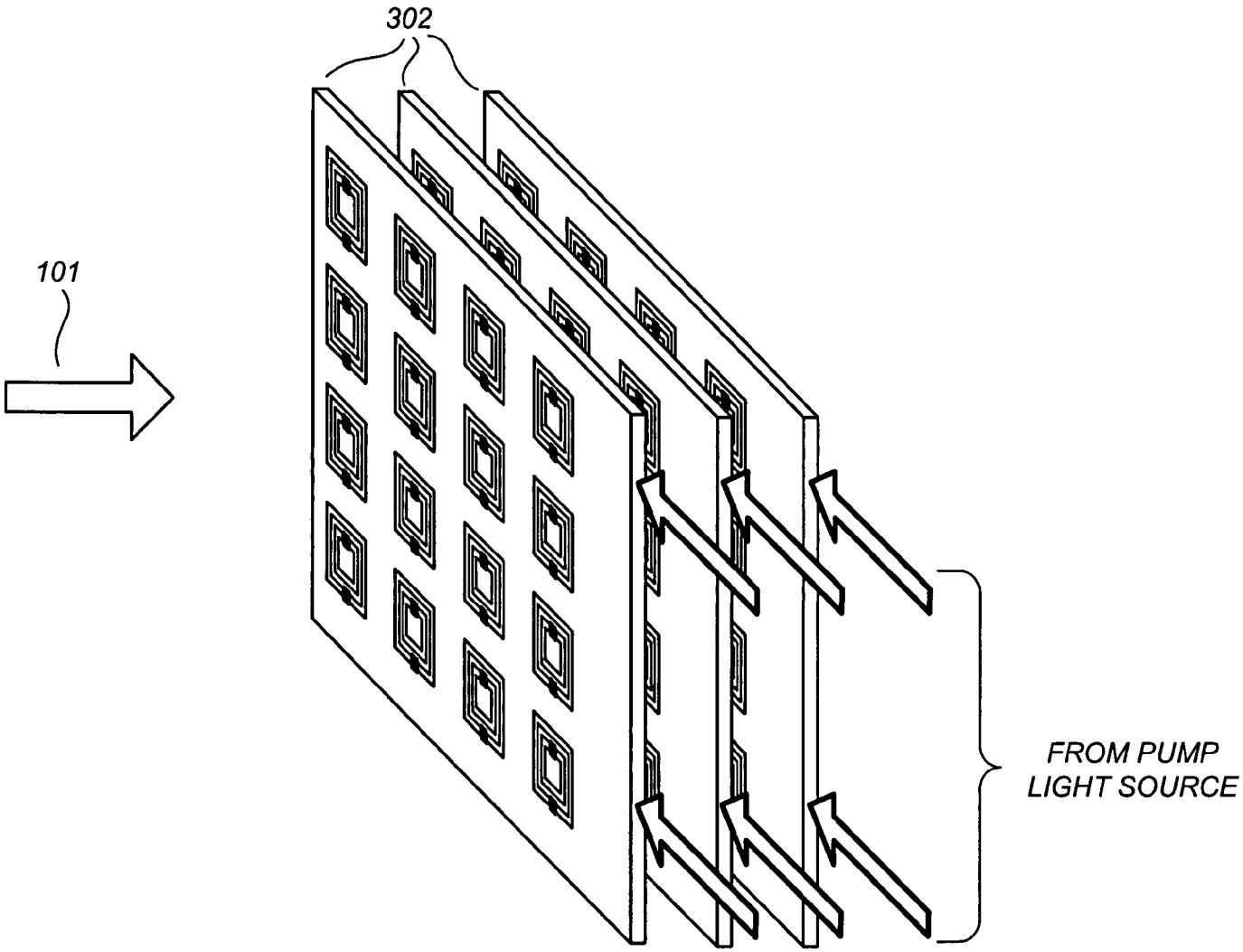
FIG. 3 illustrates a composite material according to an embodiment in which optical power is provided to an edge of a substrate upon which resonant cells are positioned.

FIG. 3 illustrates a composite material according to an embodiment in which the optical pump light is provided along the edges of the planar arrays 302, the pump light propagating inside the wafer to the optical gain material regions. Other methods for providing pump light to the optical gain elements can be used without departing from the scope of the present teachings.

FIG. 4 illustrates a resonant cell 400 of a composite material according to an embodiment having a first spatial arrangement of optical gain material similar to that of FIG. 1. Resonant cell 400 comprises a solenoidal resonator including an outer ring 402 and an inner ring 404, and optical gain elements 406 and 408. In one embodiment for which the operating wavelength is 10 μm, the pitch (i.e., center-to-center spacing) of the resonant cells is 1093 nm, the width of each of the inner and outer rings 402 and 404 is 115 nm, the notch width A is 115 nm, the inter-ring gap width B is 115 nm, the inner dimension C of the inner ring 404 is 288 nm, and the outer dimension D of the outer ring 402 is 977 nm. For operating wavelengths in approximately the 3–30 μm range, the optical gain elements 406 and 408 can comprise mid-infrared (MIR) lead salt lasers, such as PbS/PbSrS multi-quantum well lasers or PbSnTe/PbEuSeTe buried heterostructure diode lasers, with the particular structure and materials being selected such that amplification band of the optical gain material encompasses the desired operating wavelength.

Figure 5:
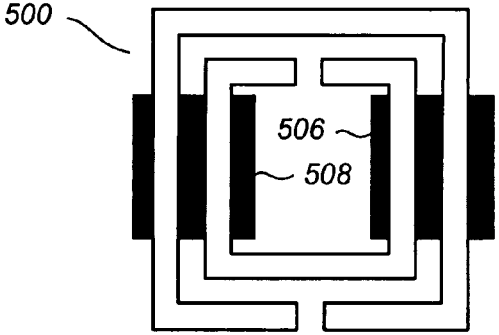
FIG. 5 illustrates a resonant cell of a composite material according to an embodiment having a second spatial arrangement of optical gain material.
Figure 6:
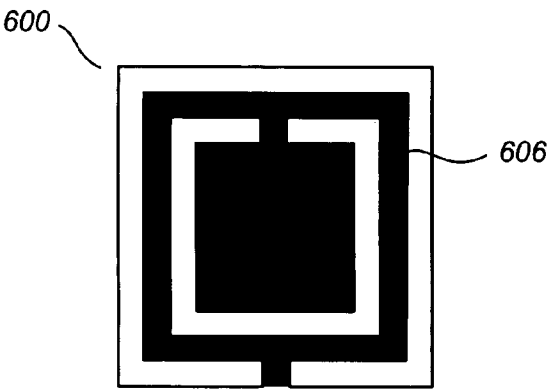
FIG. 6 illustrates a resonant cell of a composite material according to an embodiment having a third spatial arrangement of optical gain material.

The position of the optical gain material relative to the solenoidal resonator can be varied, provided that a substantial amount of its resonant field intersects a substantial portion of the optical gain material. FIG. 5 illustrates a resonant cell 500 of a composite material according to an embodiment having a second spatial arrangement of optical gain elements 506 and 508. FIG. 6 illustrates a resonant cell 600 of a composite material according to an embodiment having a third spatial arrangement of optical gain material 606.

When optical gain materials are used to power the resonant cells, any of a variety of different wavelengths of operation can be achieved by selecting the appropriate gain material having an amplification band including the desired wavelength of operation. The choice of optical gain materials is not necessarily limited to that of optical lasers. Indeed, the wavelength of operation can extend well down the spectrum, even down to the microwave frequencies. In one embodiment, for example, an operating wavelength of 1.5 cm (20 GHz) is provided by using an optical gain medium of ruby (Cr-doped $Al_2O_3$) known to be used in K-band traveling-wave ruby masers. In this case, the dimension of the resonant cells is on the order of 1.5 mm, and the ruby substrate is about 1 mm thick. Unlike with the other optical gain media described supra in which the pump wavelength generally lies in the amplification band, the ruby material would be pumped at about 50 GHz due to Zeeman splitting. Other differences include temperature control requirements, as the ruby gain material usually requires operation at liquid helium temperatures. Nevertheless, operation at microwave wavelengths represents an appealing embodiment of a composite material with powered resonant cells, because of the many practical applications (e.g., MRI, radar) in which microwave radiation is used.

Figure 7:
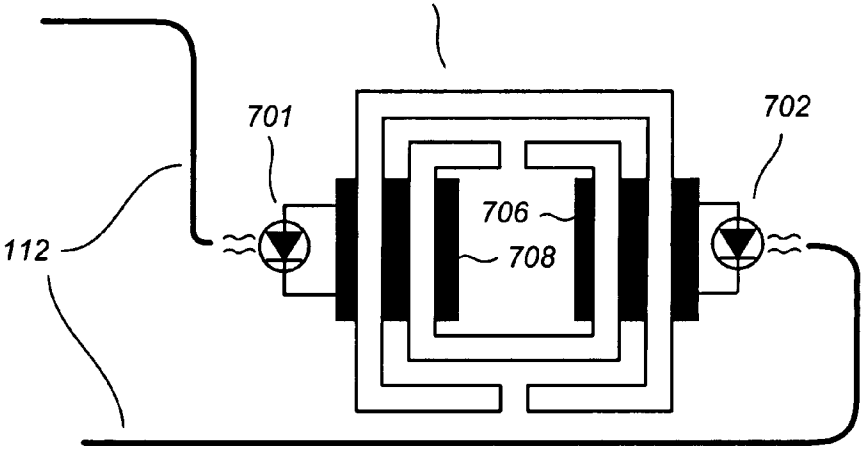
FIG. 7 illustrates a resonant cell of a composite material according to an embodiment in which the optical gain material is electrically pumped.

FIG. 7 illustrates a resonant cell 700 of a composite material according to an embodiment in which optical gain elements 706 and 708 are electrically pumped. In this embodiment, optical power is provided to the resonant cell 700 (e.g., using the optical waveguides 112 of FIG. 1) and then converted into local electrical power using photodiodes 701 and 702. This local electrical power is then provided to pump circuitry (not shown) for pumping the optical gain elements 706 and 708. The need for electrical wires for carrying external electrical power to the resonant cells is avoided, which is advantageous because such power-carrying electrical wires can potentially confound the operation of the overall composite material. For devices with small-scale resonant cells the optical waveguides 112 can be formed in the semiconductor substrate material, while for devices with larger-scale resonant cells the optical waveguides 112 can comprise optical fibers.

Figure 8:
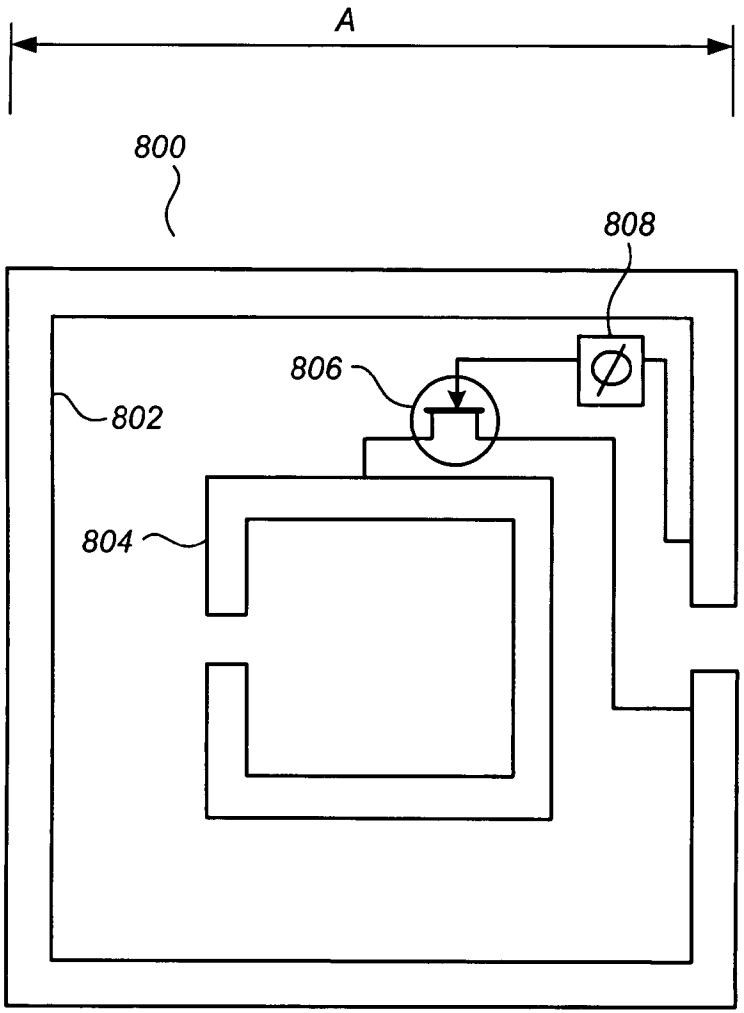
FIG. 8 illustrates a resonant cell of a composite material according to an embodiment comprising an electrical amplification circuit including a field effect transistor.

FIG. 8 illustrates a resonant cell 800 of a composite material according to an embodiment comprising an electrical amplification circuit to enhance the resonant response. Although applicable at a variety of operational wavelengths, the embodiment of FIG. 8 is particularly advantageous for microwave wavelengths in the <0.4 cm to >15 cm range (greater than 80 GHz down to 2 GHz or less). For an operational frequency of 2 GHz, the dimension A of the outer ring 802 in FIG. 8 is on the order of 1.5 cm. The electrical amplification circuit comprises a field effect transistor 806 and a phase control circuit 808 coupled among the outer ring 802 and inner ring 804 as shown. Electrical power is provided using the optical waveguide/photo diode circuit of FIG. 7 (not shown in FIG. 8).

Figure 9:
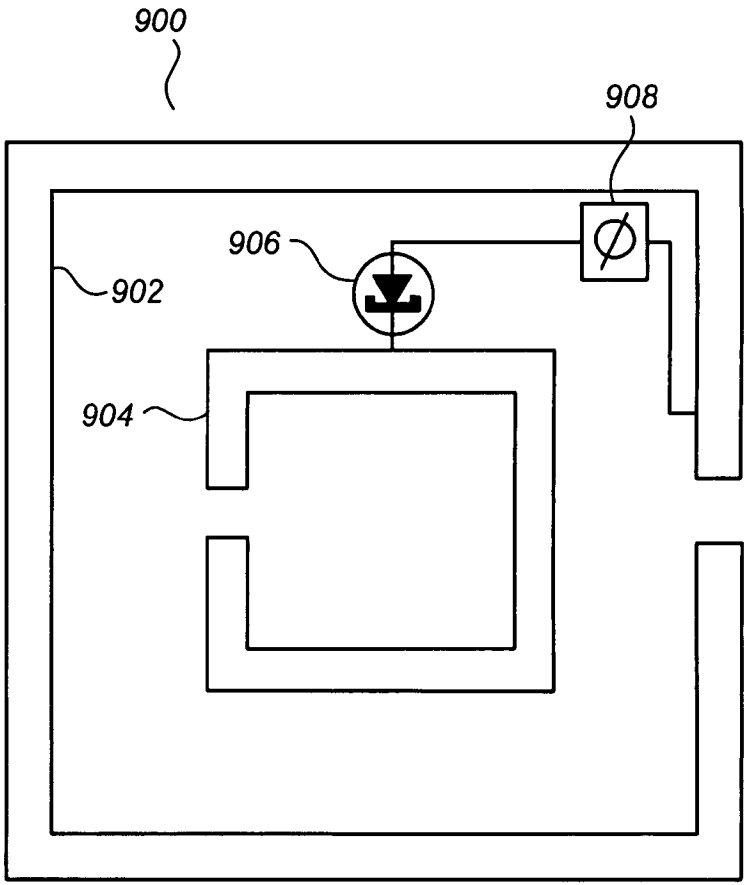
FIG. 9 illustrates a resonant cell of a composite material according to an embodiment comprising an electrical amplification circuit including a tunnel diode.

FIG. 9 illustrates a resonant cell 900 of a composite material according to an embodiment similar to that of FIG. 8, except that a tunnel diode 906 is used instead of a field effect transistor. The tunnel diode 906, which is coupled with a phase control circuit 908 among the outer ring 902 and inner ring 904 as shown, is biased to operate in its negative resistance region. Electrical power is also provided using the optical waveguide/photo diode circuit of FIG. 7 (not shown in FIG. 9).

According to another embodiment, a composite material is provided, the composite material being configured to exhibit a negative effective permittivity and/or a negative effective permeability for incident radiation at an operating wavelength, the composite material comprising an arrangement of powered resonant cells, wherein the gain elements of resonant cells lying farther along a direction of propagation of the incident radiation are configured to provide a smaller amount of gain than the gain elements of resonant cells lying nearer along a direction of propagation. As compared to an embodiment having the same overall gain but having the farther and nearer gains being the same, the embodiment having the nearer gains being greater than the farther gains has a reduced overall noise figure.

Whereas many alterations and modifications of the embodiments will no doubt become apparent to a person of ordinary skill in the art after having read the foregoing description, it is to be understood that the particular embodiments shown and described by way of illustration are in no way intended to be considered limiting. By way of example, while some embodiments supra are described in the context of negative-index materials, the features and advantages of the embodiments are readily applicable in the context of other composite materials. Examples include so-called indefinite materials (see WO 2004/020186 A2) in which the permeability and permittivity are of opposite signs.

By way of further example, powered resonant cells can be implemented on only a portion of a larger composite material, or with a subset of the possible directions of an anisotropic composite material, or interleaved in one or more directions with a continuous material as part of a larger composite material, without departing from the scope of the embodiments. By way of still further example, various parameters and/or dimensions of the composite material layers, or additional layers of composite or continuous materials, can be modulated in real-time or near-real time without departing from the scope of the embodiments. Thus, reference to the details of the described embodiments are not intended to limit their scope.

What is claimed is:

1. A composite material configured to exhibit at least one of a negative effective permittivity and a negative effective permeability for incident radiation of at least one wavelength, the composite material comprising an arrangement of electromagnetically reactive cells of small dimension relative to said wavelength, wherein each cell includes an externally powered gain element for enhancing a resonant response of said cell to the incident radiation at said wavelength.

2. The composite material of claim 1, wherein said gain element comprises an optical gain material having an amplification band that includes said wavelength.

3. The composite material of claim 2, said arrangement of cells including a first planar array thereof, wherein said optical gain material is optically pumped with a light beam originating from a source lying out of plane from said first planar array.

4. The composite material of claim 2, said arrangement of cells including a plurality of planar arrays thereof substantially parallel to each other, wherein said optical gain material for each planar array is optically pumped with light introduced along an edge thereof and propagated thereacross.

5. The composite material of claim 2, said optical gain material being formed upon a substantially planar substrate, each cell comprising an electrically conductive element formed on or near said planar substrate in close proximity to said optical gain material.

6. The composite material of claim 5, wherein said electrically conductive elements are formed into one or more of a split ring resonator pattern, a square split ring resonator pattern, a swiss roll pattern, or a thin parallel wire pattern.

7. The composite material of claim 5, wherein said wavelength is approximately in the 1.3 μm–1.55 μm range, and wherein said optical gain material comprises bulk active InGaAsP and/or multiple quantum wells according to a InGaAsP/InGaAs/InP material system.

8. The composite material of claim 5, wherein said wavelength is approximately in the 3–30 μm range, and wherein said optical gain material comprises a lead salt compound.

9. The composite material of claim 5, wherein said wavelength is approximately in the 1 cm range, and wherein said optical gain material comprises chromium-implanted aluminum oxide.

10. The composite material of claim 2, wherein said optical gain material is electrically pumped.

11. The composite material of claim 10, each cell being coupled to an optical waveguide transferring externally provided optical power thereinto, each cell further comprising:

an electro-optical conversion device converting said externally provided optical power into local electrical power for that cell; and an electrical pumping circuit using said local electrical power to pump the optical gain material of that cell.

12. The composite material of claim 1, said arrangement of cells including a first cell group and a second cell group, said second cell group being non-overlapping in space with said first cell group and lying farther along a direction of propagation of said incident radiation, wherein the gain elements of said second cell group are configured to provide a smaller amount of gain than the gain elements of said first cell group.

13. The composite material of claim 1, each cell comprising a solenoidal resonator, wherein said externally powered gain element comprises an electrical amplification circuit coupled to said solenoidal resonator.

14. The composite material of claim 13, said electrical amplification circuit comprising a tunnel diode.

15. The composite material of claim 13, each cell being coupled to an optical waveguide transferring externally provided optical power thereinto, each cell further comprising an electro-optical conversion device converting said externally provided optical power into local electrical power for use by said electrical amplification circuit.

16. A method for propagating electromagnetic radiation at an operating wavelength, comprising:

placing a composite material in the path of the electromagnetic radiation, the composite material comprising resonant cells of small dimension relative to the operating wavelength, said resonant cells being configured such that the composite material exhibits at least one of a negative effective permittivity and a negative effective permeability for said operating wavelength; and providing power to each of said resonant cells from an external power source, each resonant cell being configured to couple at least a portion of that power into a resonant response thereof for reducing net losses in the electromagnetic radiation propagating therethrough.

17. The method of claim 16, each resonant cell comprising a solenoidally resonant circuit, wherein said power is coupled through an optical gain material placed in close proximity to said solenoidally resonant circuit, said optical gain material having an amplification band that includes said operating wavelength.

18. The method of claim 17, said optical gain material being optically pumped by a light beam arising from a source other than a source of the incident electromagnetic radiation itself.

19. The method of claim 17, wherein said power is optically delivered to each resonant cell by an optical waveguide.

20. The method of claim 19, wherein said optical gain material is electrically pumped, wherein each resonant cell is configured to convert the optical power into electrical power, and wherein said electrical power is used for electrically pumping said optical gain material.

21. The method of claim 16, each resonant cell comprising a solenoidally resonant circuit, each resonant cell further comprising an electrical amplification circuit coupled to said solenoidal resonator for coupling said externally provided power into said resonant response.

22. The method of claim 21, each resonant cell being coupled to an optical waveguide for receiving externally provided optical power, wherein each resonant cell is configured to convert the optical power into electrical power for use by said electrical amplification circuit.

23. A composite material for propagating electromagnetic radiation at an operating wavelength, comprising:

a periodic pattern of resonant cells of small dimension relative to the operating wavelength, said resonant cells being configured such that the composite material exhibits at least one of a negative effective permittivity and a negative effective permeability at the operating wavelength;

wherein each resonant cell is configured to receive power from an external power source different than a source of the propagating electromagnetic radiation and to couple at least a portion of that power into a resonant response thereof for reducing net losses in the propagating electromagnetic radiation.

24. The composite material of claim 23, each resonant cell comprising a solenoidally resonant circuit, wherein said power is coupled through an optical gain material placed in close proximity to said solenoidally resonant circuit, said optical gain material having an amplification band that includes said operating wavelength.

25. The composite material of claim 24, said optical gain material being optically pumped by a common light beam incident upon said periodic pattern of resonant cells.

26. The composite material of claim 24, wherein said power is optically delivered to each resonant cell by an optical waveguide.

27. The composite material of claim 26, wherein said optical gain material is electrically pumped, and wherein each resonant cell comprises:

an electro-optical conversion device converting said optical power into local electrical power for that cell; and an electrical pumping circuit using said local electrical power to pump said optical gain material.

28. The composite material of claim 23, each resonant cell comprising a solenoidally resonant circuit, each resonant cell further comprising an electrical amplification circuit coupled to said solenoidal resonator for coupling said externally provided power into said resonant response.

29. The composite material of claim 28, each resonant cell being coupled to an optical waveguide for receiving externally provided optical power, wherein each resonant cell comprises an electro-optical conversion device for converting said optical power into electrical power for use by said electrical amplification circuit.

30. An apparatus configured to exhibit at least one of a negative effective permittivity and a negative effective permeability for incident radiation of at least one wavelength, comprising:

an arrangement of electromagnetically reactive cells, each cell being of small dimension relative to said wavelength;

means for transferring external power to each of said cells, said external power not arising from the incident radiation itself; and means for using said external power at each cell to reduce losses in said incident radiation at said wavelength as it propagates through said apparatus.

31. The apparatus of claim 30, each cell comprising a solenoidal resonator formed by conductive elements having a pattern selected from the group consisting of: split ring resonator, square split ring resonator, and swiss roll.

32. The apparatus of claim 30, further comprising a solenoidal resonator within each cell, wherein said means for using said external power comprises an optical gain material positioned in close proximity to said solenoidal resonator, said optical gain material having an amplification band that includes said wavelength.

33. The apparatus of claim 32, wherein said means for transferring comprises a pump light source configured to provide a common pump light beam to the arrangement of cells.

34. The apparatus of claim 32, wherein said means for transferring comprises an optical waveguide.

35. The apparatus of claim 32, said optical gain material being electrically pumped, said means for using said external power comprising:

means for converting the received optical power into local electrical power for that cell; and means for pumping said optical gain material using said local electrical power.

36. The apparatus of claim 32, wherein cells lying farther along the direction of propagation of incident radiation are configured to couple less gain into said solenoidal resonators than cells lying nearer along the direction of propagation for reducing a noise figure associated with said apparatus.

37. The apparatus of claim 30, each cell comprising a solenoidal resonator, wherein said means for using said external power comprises an electrical amplification circuit coupled to said solenoidal resonator.

38. The apparatus of claim 37, wherein said means for transferring comprises an optical waveguide transferring externally provided optical power into each cell, and wherein said means for using said external power further comprises an electro-optical conversion device converting said externally provided optical power into local electrical power for use by said electrical amplification circuit.

* * * * *